United States Patent [19]

Wang

[11] Patent Number: 4,698,846

[45] Date of Patent: Oct. 13, 1987

[54] PROTECTIVE PAD

[76] Inventor: Hudson Wang, 53-3, Ku-San I Rd., Ku-San District, Kaohsiung City, Taiwan

[21] Appl. No.: 889,107

[22] Filed: Jul. 23, 1986

[51] Int. Cl.[4] ..... A41D 13/00

[52] U.S. Cl. ..... 2/2

[58] Field of Search ..... 2/2, 2.5

[56] References Cited

U.S. PATENT DOCUMENTS

| | | | |
|---|---|---|---|
| 2,545,039 | 3/1951 | Mitchel | 2/2 |
| 3,158,871 | 12/1964 | Morgan | 2/2 |
| 3,431,560 | 3/1969 | Austin | 2/2 |
| 3,509,579 | 5/1970 | Morgan | 2/2 |
| 4,554,681 | 11/1985 | Kirkland | 2/2 |

*Primary Examiner*—Louis K. Rimrodt

*Attorney, Agent, or Firm*—Steele, Gould & Fried

[57] ABSTRACT

A protective pad for an athlete includes an improved securing means to releaseably secure a structural member and a pad, wherein the securing means includes a headed stud and a narrow elongate fastening opening to engage with the stud. The fastening opening has an enlarged portion for easy access by the head of the stud and an angled remaining portion for positioning the stud.

1 Claim, 6 Drawing Figures

PROTECTIVE PAD

BACKGROUND OF THE INVENTION

This invention relates to a protective pad having structural members lined with padding, particularly to one having padding easily detachable from its structural member.

Protective pads with structural members lined with releaseable padding have been developed recently to take the place of those with the structural member and padding fixed together which cannot be repaired or renewed when the padding is destroyed because of the high replacement cost and long replacement period. U.S. patent application Ser. No. 619,574 filed on May 11, 1984, and now abandoned discloses protective gear having structural members each of which is lined with a pad at the interior side thereof by a releaseable securing means which includes a strap anchored to the pad and has a free end portion turned upward to extend through an opening provided in the structural member to the exterior side. The free-end portion is provided with hook-and-loop fastener means securing releaseably the strap to the exterior side of the structural member. Such a protective pad has a disadvantage in that the hook-and-loop fastener means will separate upon being struck or subjected to impact since the fastener means is exposed on the exterior side of the structural member, thus causing the pad to become displaced relative to the structural member or separated from the structural member.

To alleviate the above disadvantages, the inventor of the present invention proposed in U.S. Patent Application Ser. No. 826,920 filed on Feb. 7, 1986, and now abandoned, that looped-straps be attached to the interior side of the structural member to be used in co-operation with straps having hook-and-loop fastener means attached to the pad and the structural member, one of the straps passing through and being turned about the looped-straps and the hook-and-loop fastener means on said one strap engaging with the hook-and-loop fastener means on the other strap to hold the structural member and the pad contiguously together. Nevertheless, it was found that such an arrangement was still disadvantageous because it is very inconvenient to bring the straps to a securing position within a narrow space.

SUMMARY OF THE INVENTION

It is an object of the invention to provide a protective pad with an improved fastener means that can conveniently secure the structural member and the pad.

The present invention provides a protective pad for an athlete which comprises: a structural member adapted to overlie the part to be protected; a pad to be disposed between the interior of the structural member and the part to be protected; and means for securing releaseably the structural member to the pad . The means includes at least two headed studs, each having a head portion, spaced apart from one another and affixed to either one of the structural member and the pad, and at least two narrow elongate fastening openings spaced apart and disposed correspondingly in either one of the structural member and the pad so as to engage with the headed studs respectively. Each of the fastening openings has an enlarged portion for easy access by the head portion of the stud, the remaining portion of the fastening opening preventing the head portion from being released in an axial direction but allowing the stud to move along the opening. The distance between the headed studs is different from that between the enlarged portions of the fastening openings such that the headed studs are positioned in the remaining portions of the fastening openings so as to secure the pad to the structural member.

In one aspect of the invention, the headed studs are disposed in the pad, and the fastening openings are disposed in the structural member, wherein the distance between the headed studs is longer than that between the enlarged portions of the narrow fastening openings, and the remaining portions of the fastening openings are substantially in a L-shape, extending from the enlarged portions respectively and turning away from one another.

BRIEF DESCRIPTION OF THE DRAWINGS

The present exemplary preferred embodiment will be described in detail with reference to the following drawings, in which.

DETAILED DESCRIPTION OF THE PREFERRED EMBODIMENT

Figure 1:
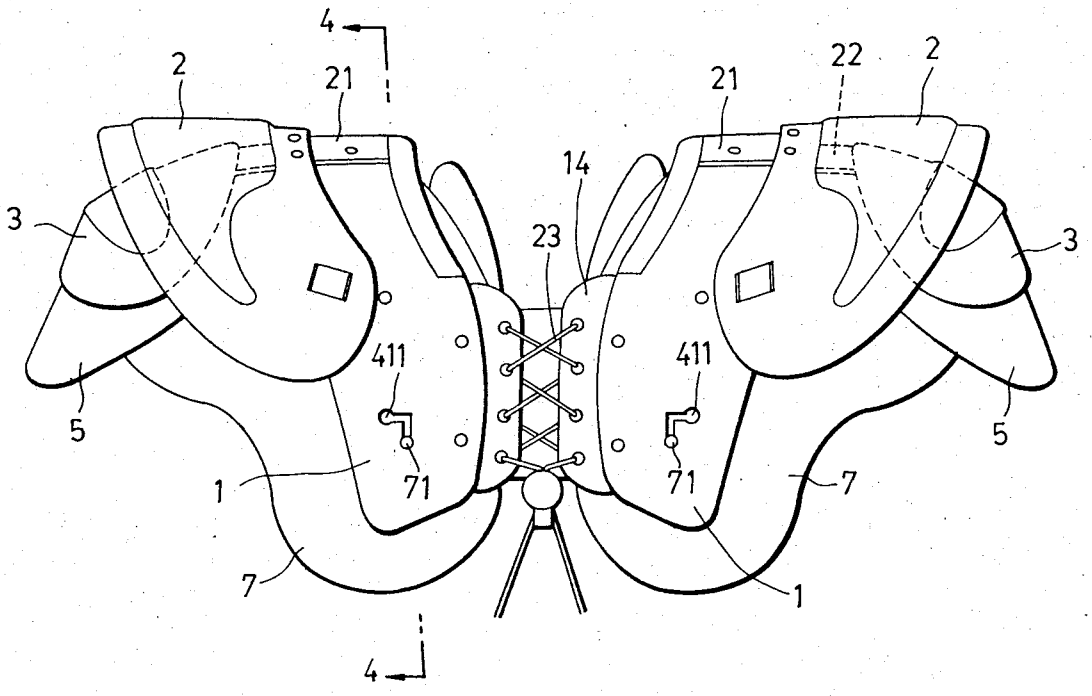
FIG. 1 is an elevation view of a protective pad incorporating the present invention.

Referring to FIG. 1, there is shown a shoulder pad used to overlie the chest, the back and the shoulder of an athlete. The shoulder pad is comprised of a pair of right and left body arches 1, a pair of right and left shoulder flaps 2, a pair of right and left shoulder caps 3, a pair of right and left pads 7 underlying the arches 1, and a pair of right and left pads 5 underlying the shoulder caps 3. Each shoulder flap 2 is secured to each body arch 1 by means of a connecting strap 22 shown in dotted lines. The right and left arches 1 are interconnected releaseably by means of lacing 23. The body arches 1 and shoulder caps 3 are structural members made of high strength plastic material and the pads 7 and 5 are formed of a foamed core and a fibrous envelope enclosing the foamed core. To simplify the drawings and the following detailed description of the protective pad, only left components are described in detail hereinunder as an illustrative example, since left and right components are of the same construction.

Figure 2:
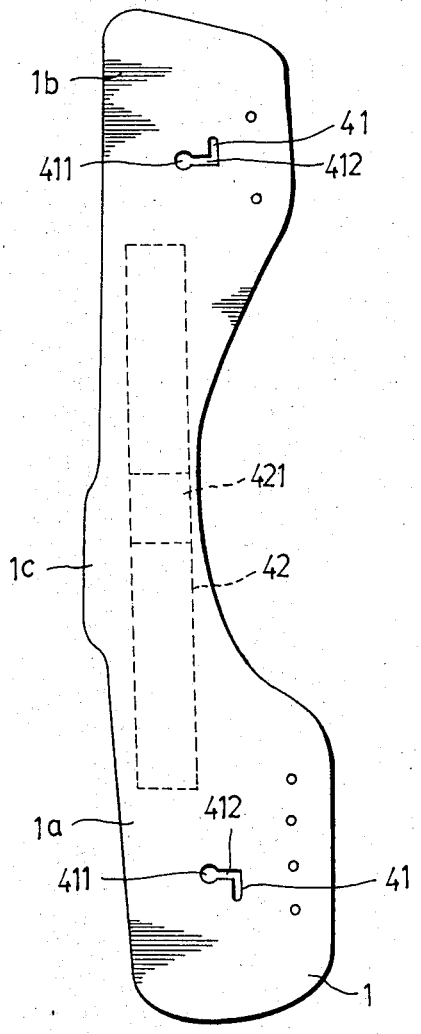
FIG. 2 is an elevation view of a body arch of the pad of FIG. 1.
Figure 3:
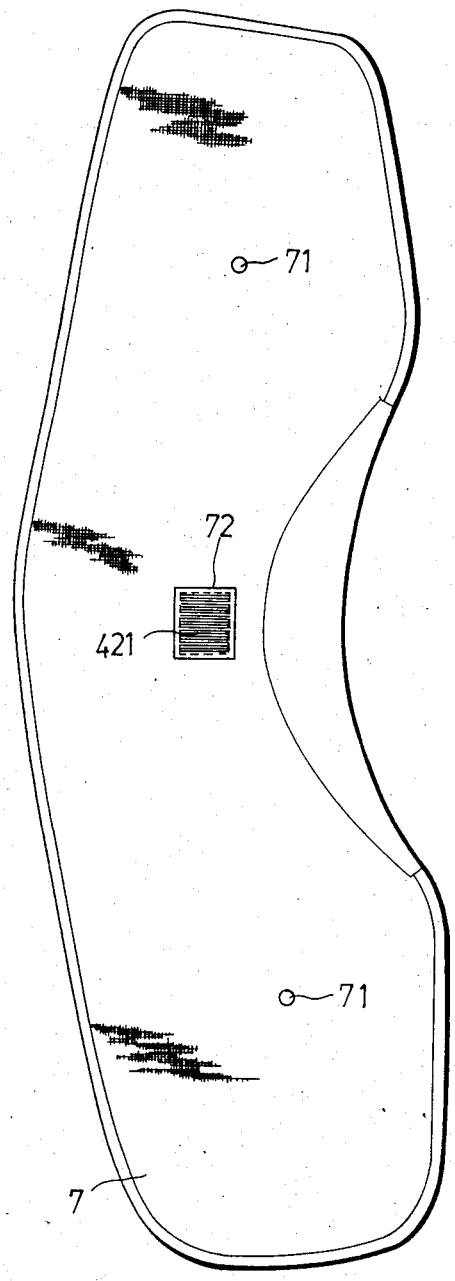
FIG. 3 is an elevation view of a pad to be secured to the body arch.
Figure 4:
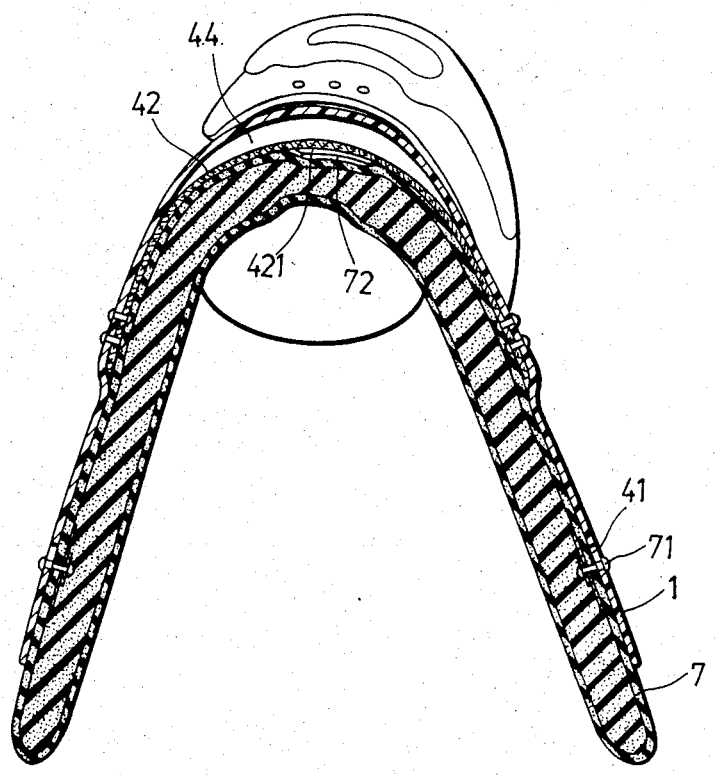
FIG. 4 is a sectional view taken along line 4—4 of FIG. 1.

Referring to FIGS. 2,3 and 4, the left body arch 1 is shown in its typical configuration having an anterior portion 1*a*, a posterior portion 1*b* and a connecting shoulder portion 1*c*. The anterior and posterior portions 1*a* and 1*b* are secured to the pad 7 by means of a fastener 71. The shoulder portion 1*c* is secured to the pad 7 by means of two straps 42 and 72 attached respectively to the pad 7 and the shoulder portion 1*c*, each bearing hook-and-loop fastener means 421 to hold the straps 42 and 72 together. The straps 42 and 72 can be can be separated from one another just by pulling the pad 7 away from the shoulder portion 1*c*. As shown in FIG. 4, the strap 42 of the body arch 1 is spaced apart from the body arch 1 so that a space 44 is created to enhance cushioning effect after the pad is secured to the arch 1.

Figure 5:
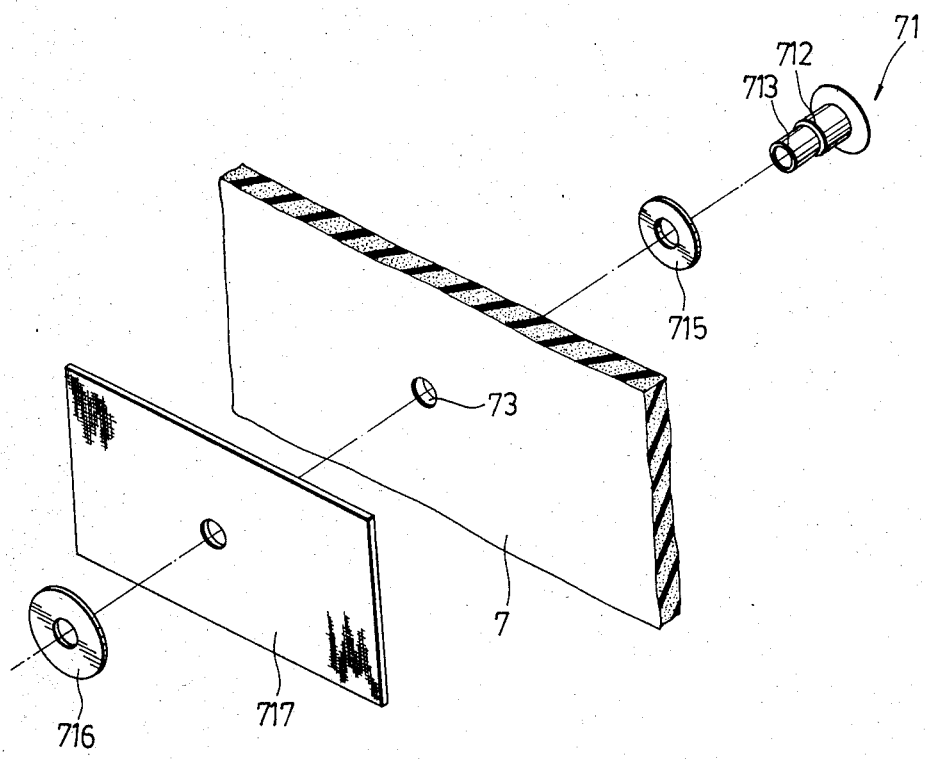
FIG. 5 is an exploded view of a securing means according to the present invention.

Referring to FIG. 5, each fastener 71 is a headed stud which has a head portion 712 and a portion 713 which is smaller in cross-section than the portion 712. The stud 71 extends through a hole 73 of the pad 7, and two rings 715 and 716 form sleeves around the portion 713. The end of the portion 713 is then enlarged under pressure so that the rings 715 and 716 tightly clamp the pad 7 between them. Between the ring 716 and the pad 7 is disposed a reinforcing plate 717 to alleviate abrasion caused to the pad 7. To secure the pad 7 to the arch 1, the anterior portion and the posterior portion of the arch 1 are provided with narrow fastening openings 41 corresponding to the locations of the studs 71 so as to engage with the studs 71 respectively. Each fastening opening 41 has an enlarged portion 411 for easy access by the head portion of the stud. The remaining portion 412 of the fastening portion is so dimensioned that it prevents the head portion of the stud 71 from being released in an axial direction but allows the stud 71 to move along the opening 41. The distance between the two headed studs 71 is longer than that between the enlarged portions 411 of the fastening openings so that the headed studs can be positioned in the remaining portions 412 of the fastening openings when the pad 7 is laid properly beneath the arch 1. The remaining portions 412 of the fastening openings are preferably substantially in an L-shape, extending from the enlarged portions 411 respectively and turning away from one another.

In connecting the pad 7 to the arch 1, the pad 7 which is flexible is collapsed to enable the studs 71 to extend into the enlarged portions 411 of the fastening openings 41 of the body arch 1. Then, the pad 7 is stretched out to cause the studs 71 to move to and be positioned at the opposite ends of the remaining portion 412 of the fastening openings 41, thereby securing the pad 7 to the body arch 1.

Figure 6:
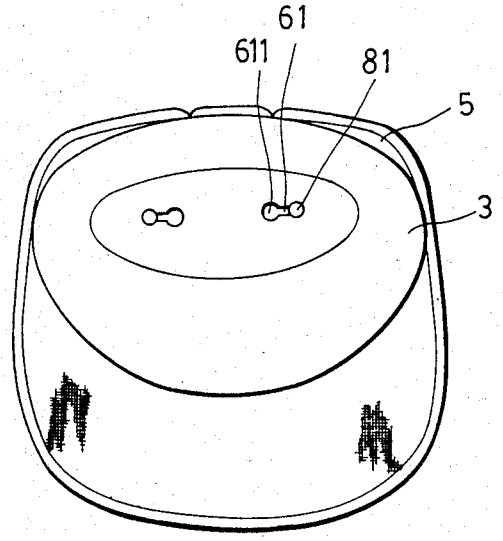
FIG. 6 is a view showing how a pad is secured to the shoulder cap of the protective pad.

FIG. 6 shows how the pad 5 is secured to the shoulder cap 3. As it is shown, a stud 81 identical to the stud 71 is attached to the pad 5 in the same way as the stud 71 is to the pad 7, and extends through a narrow fastening opening 61 which is disposed in the shoulder cap 3. The fastening opening 61 is substantially similar to the fastening opening 41, and has an enlarged portion 611 and a narrower remaining portion. The narrower remaining portion of the fastening opening is straight, unlike the remaining portion 412 of the fastening opening 41. It can be appreciated that the fastening means made according to the present invention can be worked conveniently. In addition, the studs 71 or 81 and the fastening openings 41 or 61 are not liable to separation, since any impact directed to the back, the front or the sides of the user can not cause the studs 71 to be released from the fastening openings 41. From FIG. 1, it can be noted that the stud 71 will release from the opening 41 only when a force is induced to cause the stud 71 to move upward and then to turn subsequently to the left or the right. However, it is generally impossible to create such a force when a user plays a game or engages in exercise. In the case of the pad 5 and the shoulder cap 3, the fastening opening 61 is not provided with any angled portion. In spite of this, the stud 81 will not be released from the narrower straight portion of the opening 61 since, in general, no impact force will be induced in a direction that will cause the stud 81 to move toward to the enlarged portion 611 of the fastening opening 61 when a user plays or exercises.

With the invention thus explained, it is apparent that various modifications and variations can be made without departing from the scope of the invention. It is therefore intended that the invention be limited only as indicated in the appended claims.

What I claim is:

1. In a protective pad for an athlete, having a rigid structural member adapted to overly a body part to be protected and a flexible pad to be disposed between the interior of the structural member and the part to be protected; the improvement which comprises means for releasably securing the structural member to the pad including: at least two stationary studs spaced apart from one another and affixed to the pad, each of the studs having a head portion; and the structural member having at least two narrow elongate fastening openings spaced apart from one another and disposed so as to engage with the studs respectively, each of the fastening openings having an enlarged portion for easy access by the head portion of an engaged stud, the remaining portions of the fastening openings being substantially L-shaped, extending from the enlarged portions respectively and turning away from one another, said remaining portion of the fastening opening preventing the engaged head portion from being released in an axial direction but allowing the engaged studs to move along the openings between the enlarged portions and respective termination locations separated by a distance which is equal to the distance between the studs whereby said structural member is secured to or removed from said pad only by flexing said pad.

* * * * *